United States Patent [19]

Okamoto

[11] Patent Number: 4,690,200

[45] Date of Patent: Sep. 1, 1987

[54] INDUCTION STIRRER/CONTINUOUS CASTING MOLD ASSEMBLY

[75] Inventor: Hiroshi Okamoto, Nishinomiya, Japan

[73] Assignee: Kabushiki Kaisha Kobe Seiko Sho, Kobe, Japan

[21] Appl. No.: 696,531

[22] Filed: Jan. 30, 1985

[30] Foreign Application Priority Data

Feb. 16, 1984 [JP] Japan ..... 59-21467[U]

[51] Int. Cl.[4] ..... B22D 27/02; B22D 11/124; B22D 11/04

[52] U.S. Cl. ..... 164/504; 164/443; 164/416; 164/418

[58] Field of Search ..... 164/468, 504, 443, 485, 164/478, 416, 418

[56] References Cited

U.S. PATENT DOCUMENTS 3,153,820 10/1964 Criner ..... 164/504
4,009,749 3/1977 Alberny ..... 164/504
4,164,974 8/1979 Ruer et al. ..... 164/468 X
4,173,251 11/1979 Scheinecker ..... 164/436
4,582,110 4/1986 Mizota ..... 164/504

FOREIGN PATENT DOCUMENTS 56-139261 10/1981 Japan ..... 164/504

*Primary Examiner*—Kuang Y. Lin
*Attorney, Agent, or Firm*—Oblon, Fisher, Spivak, McClelland, & Maier

[57] ABSTRACT

An induction stirrer/mold assembly for use on a continuous casting machine, which includes a coil assembly having an outer frame securely fastened to a vibrating table of the casting machine and accommodating induction stirring coils in the outer frame; and a continuous casting mold assembly detachably mounted on the outer frame of the coil assembly, the four sides of the mold being constituted by separable mold walls each having a copper facing plate securely joined to a reinforcing back-up plate.

5 Claims, 4 Drawing Figures

INDUCTION STIRRER/CONTINUOUS CASTING MOLD ASSEMBLY

BACKGROUND OF THE INVENTION

1. Field of the Invention

This invention relates to an induction stirrer/mold assembly for a continuous casting apparatus, and more particularly to improvements in induction stirrer/mold assembly useful for stirring molten metal in a mold by electromagnetic hydrodynamic action.

2. Description of the Prior Art

In the continuous casting process, it is known to employ an induction stirrer/mold assembly incorporating electromagnetic inductors around a mold to produce rotating or moving magnetic fields, thereby rotating the molten metal which flows into the mold for the purpose of facilitating accelerated flotation and separation of non-metallic inclusions and adjusting the solidified structure in the cast stock for improvement of internal segregations.

Mold assemblies of this sort are described, for example, in French Pat. Nos. 2,238,564 and 2,315,344, in which a tubular jacket of a non-magnetic material is placed in a space defined within a tubular element of copper or copper alloy and a tubular outer casing positioned concentrically with the tubular element and connected to the tubular element by a lid and a bottom plate each with an opening of a shape corresponding to the sectional shape of the tubular element. Electromagnetic inductors are mounted within the tubular jacket in such a manner as to form a number of predetermined cooling water passages. Since the electromagnetic inductors of a mold of this type are immersed in cooling water, it becomes necessary to disassemble and reassemble the mold off line for replacement when the tubular element of copper or copper alloy or the mold wall has worn out as a result of casting operation over a certain time period. In order to maintain satisfactory productivity and efficiency of continuous casting equipments, the demands for mold replacement must be immediately Fulfilled by providing a number of spare molds corresponding to that of the molds which are in service. However, a large equipment cost is incurred--; since electromagnetic inductors with the required properties are extremely expensive.

Further, the mold replacement technique takes a long time for disconnecting and connecting large power cables which are required for the electromagnetic inductors for supply thereto of a large current oftentimes as high as several hundreds to several thousands of amperes. In a case where the mold assembly employs separate cooling systems, one for cooling the mold itself and the other for preventing heat generation of the electromagnetic inductors, mold replacement technique takes a longer time for disconnecting and connecting the pipes of these cooling systems.

SUMMARY OF THE INVENTION

The present invention contemplates to solving in a rational way the problems connected with the molds incorporating an induction stirrer by providing a mold assembly separable from electromagnetic inductors which are mounted on a mold vibrating frame for imparting rotary motion to the molten metal in the mold and permitting replacement of the mold alone independently of the electromagnetic inductors.

More specifically, it is an object of the present invention to provide an induction stirrer/continuous casting mold assembly which can cut equipment costs by reducing the number of expensive electromagnetic inductors necessary for the continuous casting operation.

It is another object of the invention to provide an induction stirrer/continuous casting mold assembly which permits aligning the mold with cast strip guide means under the mold assembly at the time of mold Replacement and to cut the time required for mold replacement.

According to the present invention, there is provided an induction stirrer/mold assembly for use on a continuous casting machine, the stirrer/mold assembly comprising: a coil assembly having an outer frame securely fastened to a vibrating table of the casting machine and accommodating induction stirring coils in the outer frame; and a continuous casting mold assembly detachably mounted on the outer frame of the coil assembly, the four sides of the mold being constituted by separable mold walls each having a copper facing plate securely joined to a reinforcing back-up plate.

The above and other objects, features and advantages of the invention will become apparent from the following description and appended claims, taken in conjunction with the accompanying drawings which show by way of example some preferred embodiments of the invention.

Figure 1:
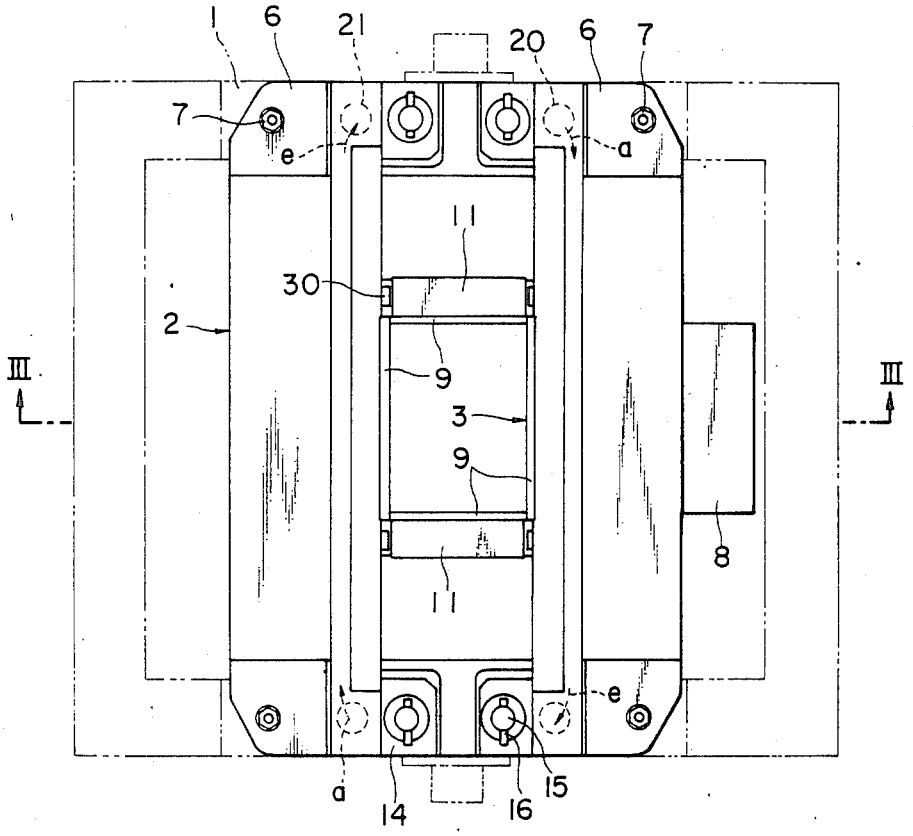
FIG. 1 is a schematic plan view of an induction stirrer/mold assembly for a continuous molding apparatus, embodying the present invention.
Figure 2:
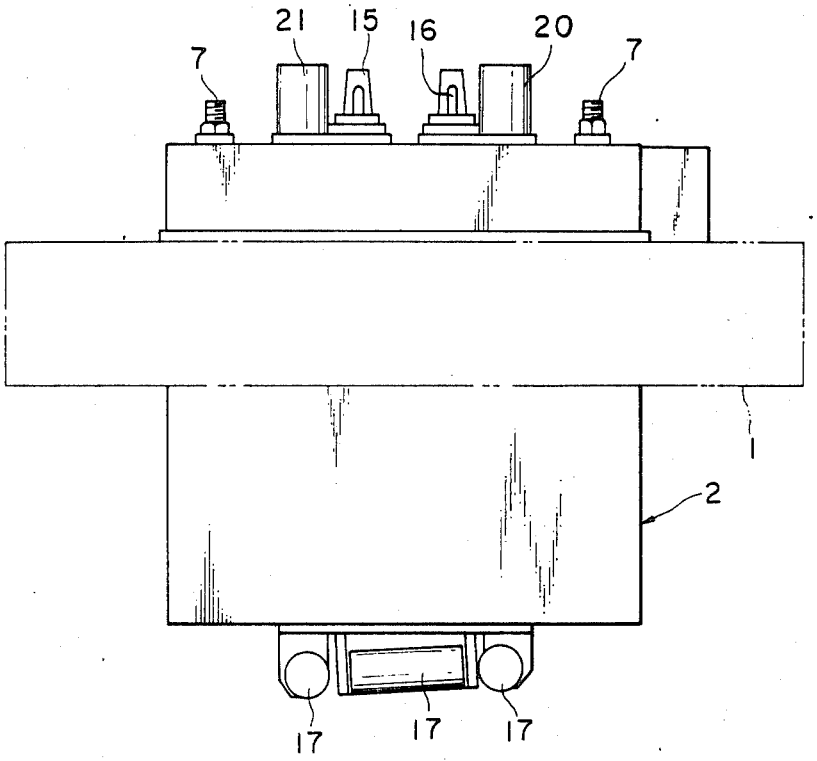
FIG. 2 is a schematic side view of the induction stirrer/mold assembly of FIG. 1.

DETAILED DESCRIPTION OF PREFERRED EMBODIMENT.

Hereafter, the invention is described more particularly by way of a preferred embodiment shown in the drawings. The mold assembly according to the invention includes a coil assembly 2 received in a vibrating table 1 of a continuous casting machine, the vibrating table 1 being substantially in the form of a rectangular frame, and a mold assembly 3 received in a frame of the coil assembly 2.

The coil assembly 2 which accommodates electromagnetic inductors 4 for imparting rotary motions to the molten metal has a rectangular frame 5 of L-shape in section, which is open on the inner side and receives therein the electromagnetic inductors 4 in such a way that the operating sides of the inductors 4 face inwards. The frame 5 is securely fixed to the vibrating table 1 by bolts 7 at fitting portions 6 which are formed in upper portions thereof. Further, cotter pins 15 are provided on the frame for mounting the mold assembly 3, and the frame 5 is provided with a terminal box 8 for connection to a supply of power or cooling water to be fed to the electromagnetic inductors 4.

Figure 4:
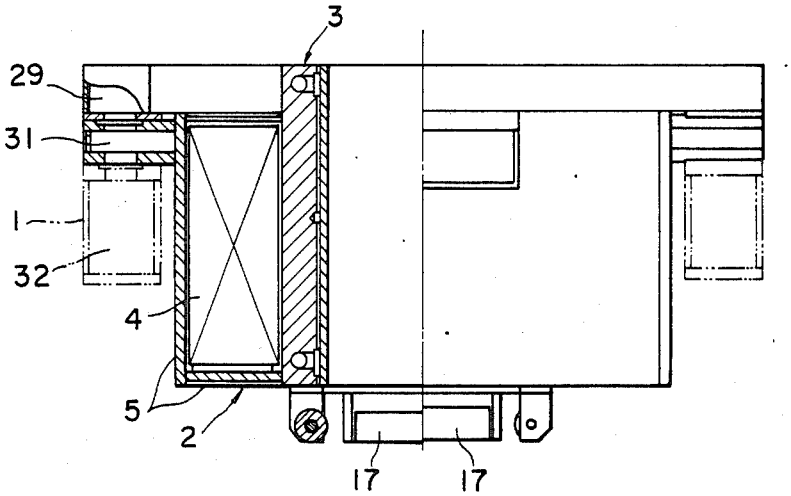
FIG. 4 is a sectional view taken on line IV—IV of FIG. 3.

In the particular embodiment shown, the mold assembly 3 is arranged to provide, for example, a mold for casting blooms. The respective mold walls 9 basically have the same construction and are assembled by bolts or other suitable fastening means to form longer and shorter sides of the mold walls having dimensions corresponding to those of the bloom to be cast. The mold walls 9 each have a facing plate 10 of copper or copper alloy on the inner side which contacts the molten metal, and a back-up plate 11 which is securely fixed to the copper facing plate 10 to guarantee the required strength of the mold. The back-up plate 11 is formed of a non-magnetic metal like stainless steel, for example, in order to reduce the loss of electromagnetic force of the inductor 4. For mounting the mold assembly 3 on the frame 5, the back-up plates 11 on the longer sides are formed with fitting portions 14 which extend onto the frame 5 and are provided with holes for receiving the cotter pins 15. These holes are preferably elongated slots to permit relative movement of the mold assembly 3 and frame 5 when adjusting the alignment of the mold assembly 3 as will be described hereinbelow. For cooling the molten metal, the back-up plates 11 and copper facing plates 10 are provided with cooling water passage grooves 12 in communication with longitudinal water passages 26 which are formed in the upper and lower portions of the respective mold walls. The longitudinal water passages 26 are connected to intercommunicating passages 25 which are formed in the back-up plates 11 at suitable intervals. The joint surfaces of the back-up plates 11 and copper facing plates 10 are sealed by an O-ring 13. A water jacket 22 is formed on the rear side of each back-up plate 11 by the use of a non-magnetic metallic material, the water jacket 22 being divided into two chambers by a partition wall 24 which is provided in an upper portion of the water jacket 22. One chamber of the water jacket 22 serves as a cooling water supply passage chamber 27, while the other chamber serves as a cooling water discharge passage chamber 28. These cooling water supply and discharge passagechambers 27 and 28 are communicated with a water box 29 which is formed in the back-up plate 11. Although cooling water may be supplied to and discharged from the mold walls of the longer and shorter sides independently of each other, it is preferred to branch off the cooling water supply and discharge passages of the longer sides and to connect the same to the shorter sides by means of connectors 30 for the purpose of simplifying the piping arrangements of the cooling system. The piping for supplying and discharging cooling water to and from such cooling system of the mold assembly 3 which is set in the coil assembly 2 can be further simplified by providing cooling water supply and discharge boxes 31 and 32 on the frame 5 and vibrating table 1, respectively, as shown in FIG. 4. Foot rolls 17 are mounted at the lower end of the mold assembly 5 though they are not necessarily required. However, it is recommended to provide such foot rolls 17 to support and prevent break-out of a cast strip which comprises a thin shell immediately beneath the mold assembly.

Figure 3:
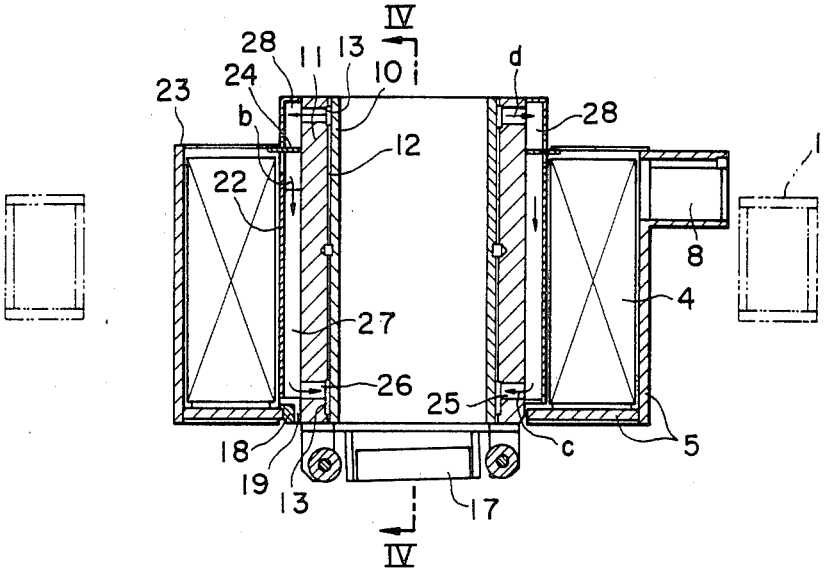
FIG. 3 is a sectional view taken on line III—III of FIG. 1.

Provided between the mold assembly 3 and frame 5 is a mold aligning means for adjusting the position of the mold assembly 3 on the frame 5 relative to a cast strip guide consisting of, for example, a number of guide rollers which are located in a secondary cooling zone immediately beneath the mold assembly 3. Namely, as illustrated in FIG. 3, reference blocks 18 are fixed to the lower end of the mold assembly 3 by welding or bolts in at least two different positions on a back-up plate 11 opposing an end face of the bottom wall of the frame 5 (the end face providing a reference plane for determining the alignment of the guide rollers), and shims 19 are attached to the reference blocks 18 by bolts. When mounting a mold assembly 3 on the frame 5, the surfaces of the mold walls 9, with replacing or reground copper plates 10 provided on the back-up plates 11, are first aligned with the foot rolls 17, and then the thickness of the shims 19 is adjusted in such a manner as to maintain a predetermined distance between the end faces of the shims 19 and the mold wall 9. Thereafter, the mold assembly 3 is fitted into the outer frame 5, pressing the end faces of the shims 19 of the reference blocks 18 against the end face of the bottom wall of the outer frame 5, and fixing the mold assembly 3 to the outer frame 5 by the cotters 13. Although the reference blocks 18 are provided on the mold assembly 3 in the particular example shown, they may be attached to the bottom wall of the outer frame 5 if desired. However, it is advantageous to provide the reference blocks 18 on the mold assembly 5 to adjust the mold alignment promptly in a facilitated manner.

For replacing the copper plates 10 of the mold walls, fresh copper plates are attached to the back-up plates 11 of the longer and shorter sides, along with necessary seal means for the cooling water passages, and then the mold walls are re-assembled to provide a mold assembly 3 having dimensions corresponding to the bloom to be cast. At this time, the thickness of the shims 19 on the reference blocks 18 at the lower end of the mold assembly 3 is adjusted so that the end faces of the shims 19 and the opposing surface of the mold wall are spaced from each other by a predetermined distance, and, in a case where the mold assembly is provided with the foot rolls 17, the mold wall surfaces are also aligned with the foot roll surfaces. This mold assembly 3 is then mounted on the coil assembly 2 on the vibrating frame 1, fitting the cotter pins 15 on the coil assembly in the elongated slots which are formed in the fitting portions of the mold assembly 3. The mold assembly 3 is moved until the reference blocks 18 at the lower end of the mold assembly 3 are abutted against the end face of the bottom wall of the frame 5. The mold assembly 3 is securely fixed to the coil assembly 2 by fitting cotters 16 in the cotter pins 15, with the reference blocks 18 held in intimate contact with the end face of the bottom wall of the frame 5. Upon mounting the mold assembly 3 on the coil assembly 2, the mold is automatically aligned with the cast strip guide means which is located beneath the mold, simultaneously connecting its cooling water supply and discharge passages with the corresponding ones on the part of the coil assembly 2.

As is clear from the foregoing description, the induction stirrer/continuous casting mold assembly according to the invention has a number of advantages as follows:

(a) The production cost can be cut since spare parts for the replacement of coils are unnecessary.

(b) The job of connecting cable and cooling water pipes can be reduced to a minimum.

(c) The productivity Required for the continuous casting operation can be enhanced by reduction of the time of mold replacement.

(d) The number of spare parts required for replacement for mold can be reduced, permitting easier handling.

(e) The size of the mold can be altered easily.

Obviously, numerous modifications and variations of the present invention are possible in light of the above teachings. It is therefore to be understood that within the scope of the appended claims, the invention may be practiced otherwise than as specifically described herein.

What is claimed is:

1. An induction stirrer/mold assembly for use on a continuous casting machine, comprising:

a vibrating table;

a coil assembly having an outer frame securely fastened to said vibrating table;

a plurality of induction stirring coils accommodated in said outer frame;

a continuous casting mold assembly detachably mounted on said outer frame of said coil assembly, wherein sides of said mold assembly comprise separable mold walls each having a copper facing plate and a reinforcing back-up plate wherein said copper facing plate is connected to said reinforcing back-up plate;

cast strip guide means located in a secondary cooling zone immediately beneath said mold assembly; and mold aligning means for adjusting the position of said mold on said frame which comprise at least first and second reference blocks adjustably fixed at a lower end of said mold walls, said reference blocks being abuttingly engagable with an end face of a bottom wall of said outer frame of said coil assembly to hold said mold assembly in alignment with said cast strip guide means and a shim member attached to at least one of said reference blocks for adjusting the position of said mold assembly relative to said cast strip guide means.

2. The induction stirrer/mold assembly of claim 1, wherein said mold walls on longer sides of said mold assembly further comprise longitudinal extensions at upper ends thereof, said longitudinal extensions being detachably fixed on said outer frame of said coil assembly.

3. The induction stirrer/mold assembly of claim 1, wherein each one of said mold walls is provided with cooling water passage grooves on joining surfaces of said copper facing plate and back-up plate and longitudinal water supply and discharge passages formed in upper and lower portions of said mold wall wherein said water passage grooves communicate with said longitudinal water supply and discharge passages, and a water jacket formed on a rear side of said back-up plate and wherein said back-up plate includes intercommunicating passages for communicating said water jacket with said cooling water supply and discharge passages.

4. The induction stirrer/mold assembly of claim 3, further comprising means positioned in said water jacket to divide said water jacket into two chambers to form a cooling water supply passage chamber and a cooling water discharge passage chamber wherein said water jacket is connected to said cooling water supply and discharge passage chambers on a part of said coil assembly upon fitting of said mold assembly in said outer frame of said coil assembly.

5. The induction stirrer/mold assembly of claim 1, wherein said mold assembly further comprises a plurality of foot rollers positioned at a lower end thereof.

* * * * *